US005625900A

United States Patent [19]

Hayes

[11] Patent Number: 5,625,900

[45] Date of Patent: May 6, 1997

[54] HIGH GRIP GLOVE

[75] Inventor: Christopher J. Hayes, Rockford, Mich.

[73] Assignee: Specialty Sports Limited, Rockford, Mich.

[21] Appl. No.: 400,614

[22] Filed: Mar. 8, 1995

[51] Int. Cl.[6] ..... A41D 19/00

[52] U.S. Cl. ..... 2/161.8; 2/169; 2/168; 2/159

[58] Field of Search ..... 2/161.1, 161.3, 2/161.8, 166, 169

[56] References Cited

U.S. PATENT DOCUMENTS

| | | | |
|---|---|---|---|
| 1,179,871 | 4/1916 | St. John | 2/161.3 X |
| 4,172,293 | 10/1979 | Vistins | 2/169 |
| 4,497,072 | 2/1985 | Watanabe | 2/161.1 X |
| 4,689,832 | 9/1987 | Mulvaney | 2/161.1 X |
| 4,691,387 | 9/1987 | Lopez | 2/161.1 X |
| 5,117,509 | 6/1992 | Bowers | 2/161.1 |
| 5,164,231 | 11/1992 | Davis | 2/161.3 X |
| 5,419,014 | 5/1995 | Piantedosi | 2/161.8 X |

*Primary Examiner*—C. D. Crowder
*Assistant Examiner*—Shirra L. Jenkins
*Attorney, Agent, or Firm*—Price, Heneveld, Cooper, DeWitt & Litton

[57] ABSTRACT

A glove especially useful in skiing, snowmobiling, and the like with a silicone elastomeric polymer coating that is soft and tacky on at least the palm area of the glove.

7 Claims, 3 Drawing Sheets

HIGH GRIP GLOVE

BACKGROUND OF THE INVENTION

The present invention relates to cold-weather gloves such as snowmobile gloves, ski gloves, and the like. The more expensive gloves come with leather palms, which give a snowmobiler or skier a good grip. However, to enable consumers to purchase such gloves at a lower price point, the gloves are often provided with synthetic polymer palms, which do not have the gripping characteristics of leather.

The surfaces of the palms of work gloves are often dotted with separate, raised beads of polymeric material, ostensibly for the purpose of improving the grip of the glove. These polymer beads are relatively hard, however, such that any enhanced gripping is the result of making the surface of the glove irregular.

SUMMARY OF THE INVENTION

The present invention comprises a glove in which at least the palm area is coated with a soft, somewhat tacky to the touch elastomer which gives the glove excellent gripping properties. The elastomer is preferably applied in a continuous, embossed pattern, and most preferably is applied to an underlying layer of synthetic leather, which in turn is secured to at least the palm area of the glove.

The gloves of the present invention are useful as snowmobile gloves, ski gloves, work gloves, etc. where economical increased gripping potential is desirable. These and other objects, advantages and features of the invention will be more fully understood and appreciated by reference to the written specification and appended drawings.

DETAILED DESCRIPTION OF THE PREFERRED EMBODIMENT

Figure 2:
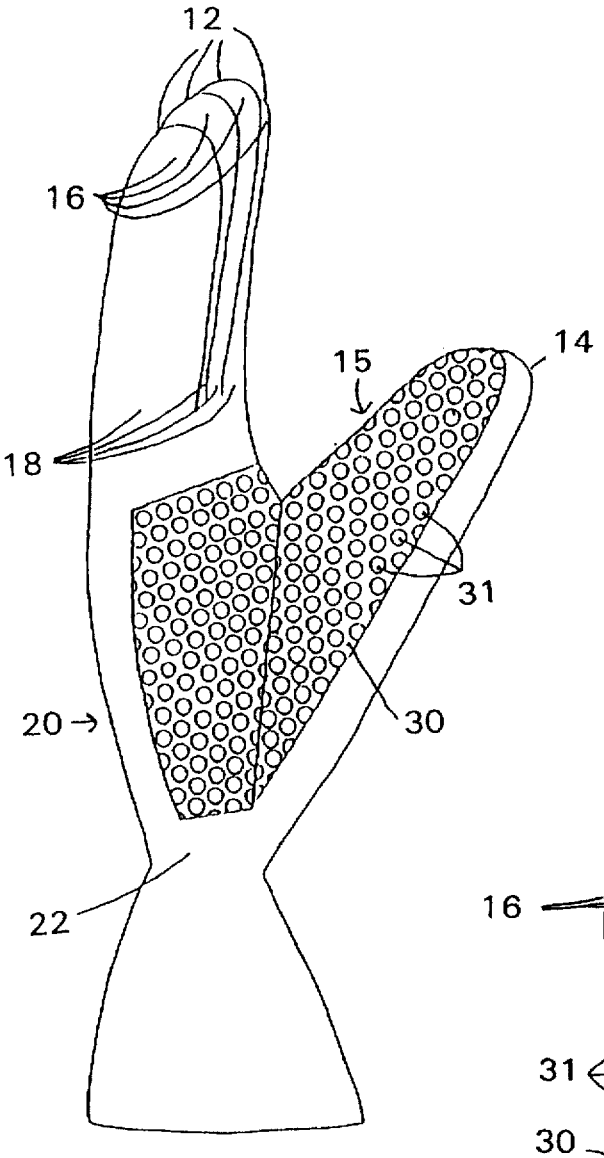
FIG. 2 is a side view of the glove, showing the elastomeric polymer layer extending on the inner surface of the thumb facing the palm, as well as in the palm area.
Figure 3:
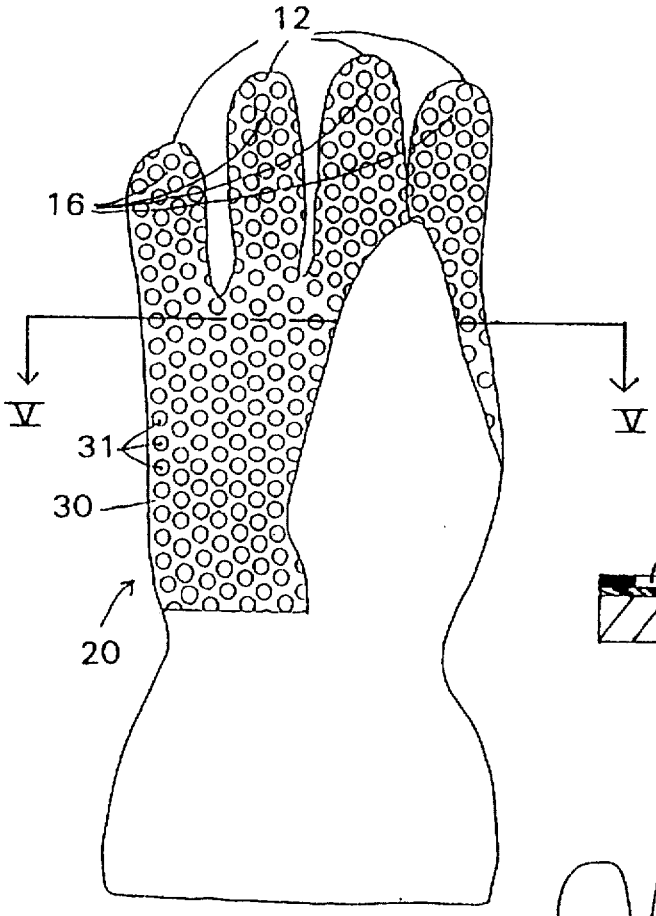
FIG. 3 is a plan view of the palm side of the glove, showing the elastomeric polymer layer extending to the tips of the fingers as well as the palm area.
Figure 5:
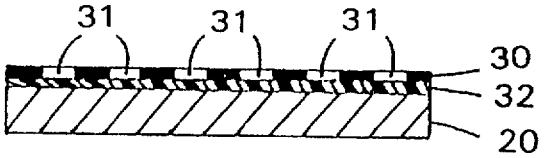
FIG. 5 is an enlarged, fragmentary, cross-sectional view of the palm of the glove taken generally along the lines V—V of FIG. 3.
Figure 4:
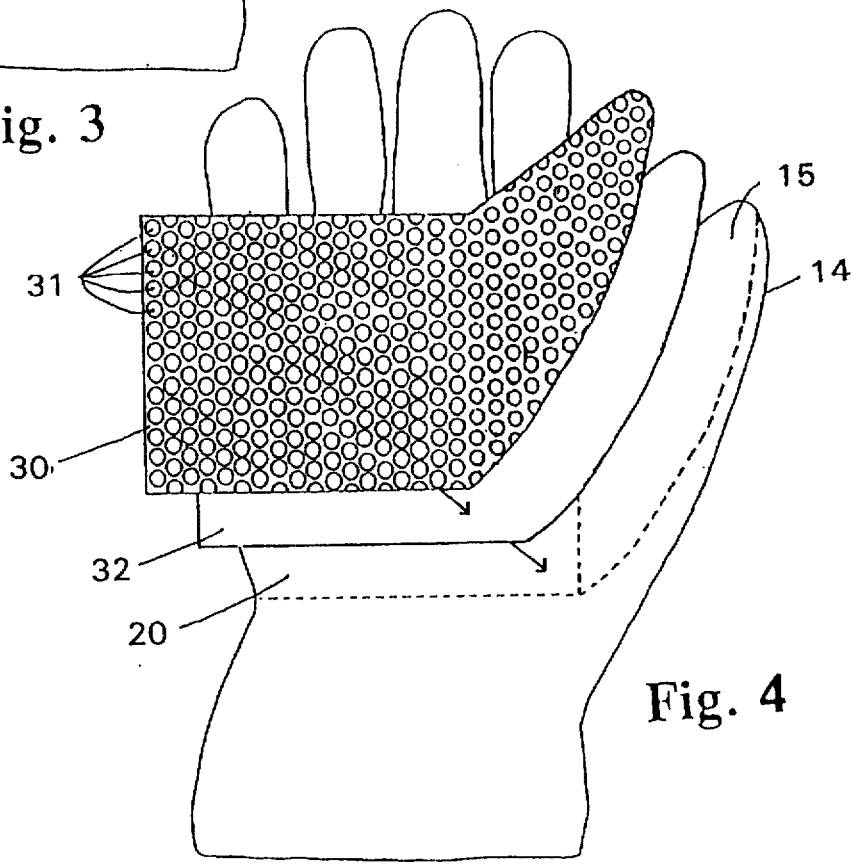
FIG. 4 is an exploded view of the palm side of the glove, showing the elastomeric polymer layer and artificial leather layer on the palm area and inner thumb surface of the glove.

In the preferred embodiment, glove 10 is provided with a layer 30 of tacky, elastomeric polymer material applied to the palm area 20 and inner thumb surface 15, giving the glove excellent gripping capability (FIGS. 1–5). In the most preferred embodiment, elastomeric layer 30 is applied in a continuous pattern, with regularly and closely spaced openings 31 therein, over a layer of artificial leather 32 (FIGS. 4 and 5).

The soft, tacky, elastomeric polymer material 30 which gives glove 10 increased gripping is easily applied to the palm area of a glove, has a soft, tacky feel, and stays soft and tacky even in extremely cold conditions. While feeling slightly tacky to the touch, the elastomer retains its integrity and does not separate and stick to other surfaces. Preferably, tacky polymer material 30 is a silicone elastomer. These materials are less expensive than the traditional leather-grip gloves, allowing consumers to purchase gloves with outstanding gripping quality at a much lower price.

Silicones are a family of synthetic polymers which are partly organic and partly inorganic, possessing a quartz-like polymer structure made up of alternating silicon and oxygen atoms rather than the carbon-to-carbon backbone characteristic of organic polymers. Silicones can be classified as fluids, elastomers, and resins. Their physical form is determined by molecular weight, extent of crosslinking between polymeric chains, and type and number of organic groups attached to the silicon atoms. Their properties include: (a) relatively uniform properties over a wide temperature range, (b) low surface tension, (c) extreme water repellency, (d) good electrical properties, (e) inertness and compatibility, both physiologically and in electronic applications, (f) chemical inertness, and (g) weather resistance. These properties make silicone polymers particularly suitable for providing a cold-weather glove with superior gripping qualities.

One group of fluid polymers contains reactive groups such as —OH and —OR. These polymers can react to form elastomers. They are usually formulated with reinforcing and extending fillers. Most of these materials are based on dimethylsiloxane polymers, but fuel- and solvent-resistant types, the fluorosilicone, contain polymers modified with the trifluoropropyl groups.

The silicone elastomers for use in the preferred embodiment can be either the low-consistency type or high-consistency type. The low-consistency systems are pourable or easily pumped materials, and can be cured in place at room temperature or slightly elevated temperatures. They are available either as one- or two-part systems.

One-part systems cure by reaction with atmospheric moisture, releasing byproducts such as acetic acid or methanol. They are restricted to use in thin cross sections, typically in such applications as sealants. They bond strongly to glass, ceramics, metals, and most plastics. In some cases, a primer must be used.

Two-component systems cure to tom elastomers when the components are mixed, usually at room temperature, in any depth of cross section. Cure rates depend on the catalyst type, concentration, and temperature. Deep sections cure as quickly as thin sections. The properties of low-consistency two-component systems change very little with aging or with changes in environmental systems, again, making them exceptionally useful as gripping materials for cold-weather gloves.

Both the one- and two-component systems cure with little or no exotherm. Formulations are available to give a range of Shore A hardness from 0 to 60 and Bashore resiliencies from 0 to 80.

Two-part silicone elastomer formulations have been developed for liquid injection molding. Short cure times at low temperatures (such as 110 seconds at 110° C.) make this technology useful in high-speed, high-volume operations. These formulations can also be coated on fabrics.

The high-consistency type of silicone elastomers may also be used in connection with cold-weather gloves to provide the palm of the glove with outstanding gripping qualities.

The first silicone elastomers were made from these high-consistency, gum-like polymers. Vulcanization of these elastomers is done in hot air tunnels, continuous steam vulcanizers, autoclaves or hot molds. These materials are used to make most of the molded, extruded, and calendared silicone elastomer products on the market. They can be used to coat fabrics and can be employed in calendared sheets.

Once applied to the glove, the elastomeric polymer material remains soft and somewhat tacky, giving a tacky to the touch type of surface. This soft, tacky feel is largely responsible for the glove's outstanding gripping features. The material is not so sticky that it leaves a residue or film when applied to and removed from a surface. Rather, the soft, tacky material makes it very difficult for the glove to slide or move when applied to a surface. For example, if the glove is used to grip an object such as a handle on a snowmobile or a ski pole, the combination of the tacky elastomeric material and the grip of the glove wearer will result in a very secure grip between the glove and the object. A significant force would have to be exerted on the object for it to become dislodged from the user's hand. Under normal conditions, the only way the object can be released from the glove is if the user relaxes the force exerted by his hand on the object.

Because the gloves of the preferred embodiment are cold-weather gloves, it is preferable to select a gripping material that will remain soft and tacky even at very low temperatures, such as −23° C. or lower. Preferably, silicone elastomer 30 has a melting point of about 200° C. or above, and a freezing point of about −100° C. or below. The silicone polymers of the preferred embodiment provide such a material, having relatively uniform properties over a wide temperature range, including very low temperatures. Materials that harden at lower temperatures are undesirable, as the material becomes more slippery, resulting in a loss of gripping capability. Thus, the silicone elastomer preferably has a relatively low glass transition or softening temperature, yet not so low that silicone elastomer layer 30 becomes runny or peels off glove 10 under elevated temperatures of shipping and storing.

Glove 10 includes fingers 12 and thumb 14. Each finger 12 has a tip 16 and an end 18. Palm area 20 extends from approximately ends 18 of fingers 12 to heel area 22 of glove 10. Thumb 14 has an inner surface 15 which faces palm area 20 of glove 10 (FIG. 2). The term "glove" as used herein is also intended to include a mitten, in which fingers 12 would be combined into a single finger area.

Figure 1:
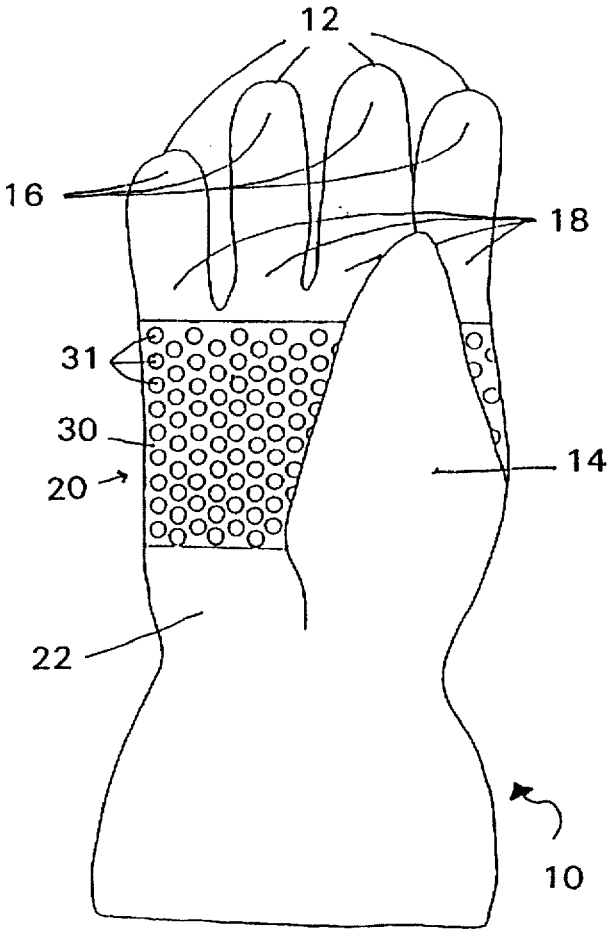
FIG. 1 is a plan view of the palm side of a glove in accordance with the present invention, showing a plurality of circular, regularly-spaced openings in the elastomeric polymer layer.

In the preferred embodiment, elastomeric polymer 30 is applied at least to palm area 20 of glove 10, extending across the width of the hand and from ends 18 of fingers 12 to about heel 22 of the hand (FIG. 1). This area is where the large majority of objects are usually gripped. More preferably, elastomeric polymer layer 30 extends along thumb 14 as well (FIG. 2), being applied to surface 15 of thumb 14 that faces palm 20. This provides for even greater gripping strength. In one alternative preferred embodiment, elastomeric polymer layer 30 extends from palm 20 and thumb area 15 to tips 16 of fingers 12 (FIG. 3). This provides for an even greater gripping potential.

Silicone elastomer 30 is preferably directly applied to synthetic leather layer 32 in liquid or semi-liquid form and then allowed to solidify. Embossed leather layer 32 is then cut to the desired configuration and is adhered and/or sewn to palm 20 of glove 10. Most preferably, elastomer 30 is calendared onto layer 32 by an embossed calendar roll, so as to create a continuous patterned polymer layer—continuous in that silicone elastomer 30 is applied in an interconnected web, patterned in that the web is interrupted by holes 31. Silicone elastomer 30 adheres well to synthetic leather 32, but not particularly well to the typical synthetic fabrics of which many gloves are made.

Any suitable leather material may be used for synthetic leather layer 32. For example, an artificial suede leather comprising micro staple fibers and polyurethane resin may be used. The ratio of constituents of synthetic leather layer 32 is not critical. As an example, a suitable synthetic leather layer 32 could be composed of 70% staple fibers and 30% polyurethane resin.

Figure 6:
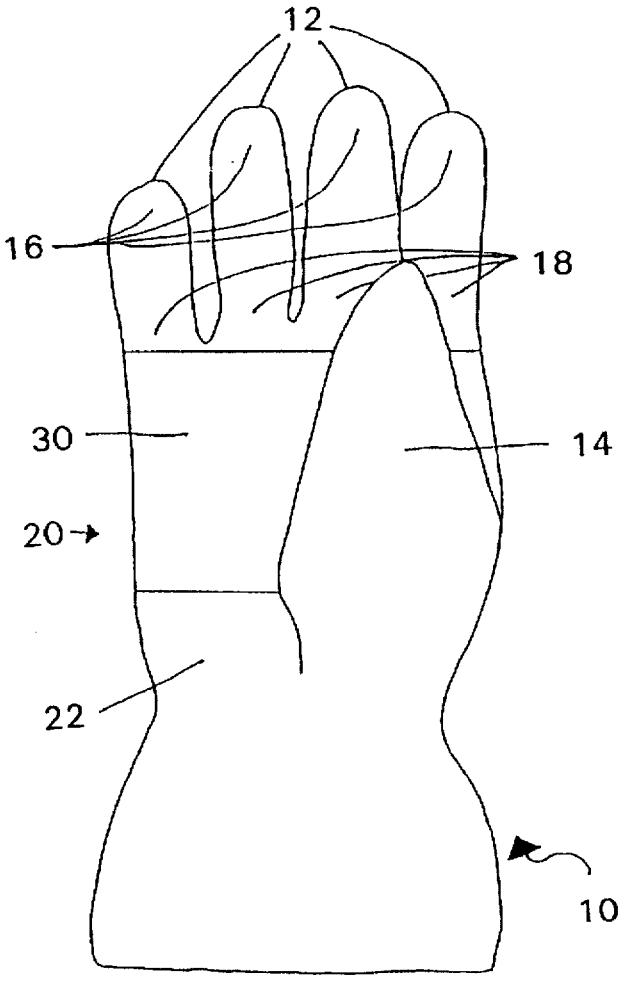
FIG. 6 is a plan view of the palm side of the glove, showing a solid layer of elastomeric polymer material affixed to the palm portion of the glove.
Figure 7:
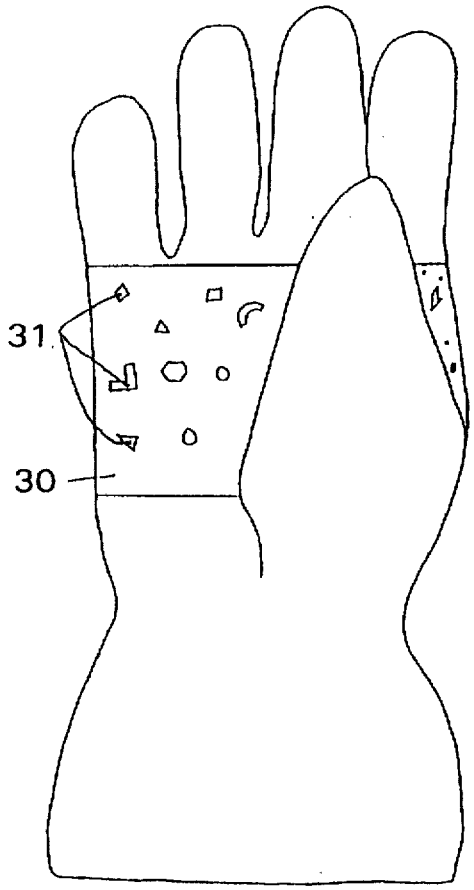
FIG. 7 is a plan view of the palm side of the glove, showing several irregularly shaped, randomly-dispersed openings in the elastomeric polymer layer.

In an alternative embodiment, elastomeric polymer layer 30 is applied to glove 10 in such a way that the underlying surface, either of glove 10 itself or an artificial leather layer 32, is completely covered by the material, there being no openings in elastomer 30 (FIG. 6). More preferably, the elastomer 30 is applied in a continuous embossed pattern, so that portions of the underlying surface (either glove 10 or synthetic leather 32) are exposed via openings 31. Such an embossed pattern aids in the displacement of any moisture that may be present between glove 10 and the object being gripped. It also gives improved gripping to the glove, as opposed to simply covering the entire underlying surface with the elastomeric polymer layer 30. In the alternative embodiment of FIG. 7, openings 31 are irregular in configuration. Most preferably, elastomer 30 is applied in a screen-like pattern, such that there are a plurality of regularly spaced, regularly shaped openings 31 through elastomeric layer 30 (FIG. 1). Preferably, openings 31 are circular in shape, are approximately 2 millimeters in diameter, and are arranged in an organized, repeating fashion.

The above description is considered that of the preferred embodiments only. Modifications of the invention will occur to those skilled in the art and to those who make or use the invention, which is defined by the following claims as interpreted according to the principles of patent law, including the doctrine of equivalents.

The embodiments of the invention in which an exclusive property or privilege is claimed are defined as follows:

1. A glove comprising a soft, tacky elastomeric polymer applied to a synthetic leather layer, which in turn is secured to the palm area of the glove, the elastomeric polymer being disposed on the synthetic leather layer in a continuous, embossed pattern such that there are a plurality of openings through the elastomeric polymer, exposing portions of the synthetic leather layer at the openings.

2. The glove of claim 1 in which said elastomeric polymer is applied to said synthetic leather layer in a screen-like pattern such that there are a plurality of openings through the elastomeric polymer, exposing portions of said synthetic leather layer at said openings.

3. The glove of claim 1 in which said soft, tacky elastomeric polymer is applied in a continuous layer with irregularly shaped and randomly spaced openings.

4. The glove of claim 1 in which said soft, tacky elastomeric polymer is applied in a layer with regularly shaped openings of the same shape.

5. The glove of claim 1 in which the silicone elastomer and synthetic leather layer are further applied to the surface of the thumb that faces the palm area.

6. The glove of claim 1 in which the silicone elastomer and synthetic leather layer are further applied to the portion of the fingers which face the palm when folded over.

7. The glove of claim 1 in which said elastomer is a silicone elastomer.

* * * * *

UNITED STATES PATENT AND TRADEMARK OFFICE

CERTIFICATE OF CORRECTION

PATENT NO. : 5,625,900
DATED : May 6, 1997
INVENTOR(S) : Christopher J. Hayes

It is certified that error appears in the above-indentified patent and that said Letters Patent is hereby corrected as shown below:

Column 2, Line 46:

"tom" should be --form--;

Column 4, Claim 6, Line 61;

"The glove of claim 1" should be –The glove of claim 5–.

Signed and Sealed this

Thirtieth Day of September, 1997

*Attest:*

Bruce Lehman

BRUCE LEHMAN

*Attesting Officer*

*Commissioner of Patents and Trademarks*